US007644991B2

(12) United States Patent
Davis et al.

(10) Patent No.: US 7,644,991 B2
(45) Date of Patent: Jan. 12, 2010

(54) CHAIR WITH FOLDING ARMREST

(75) Inventors: Judy G. Davis, Fort Worth, TX (US); Dickon Isaacs, Chicago, IL (US); Jonathan I. Kaplan, Palo Alto, CA (US); Kurtis K. Kemper, Kennedale, TX (US); Jon H. LeFors, San Francisco, CA (US); Thomas Overthun, San Francisco, CA (US); David J. Rinaldis, Redwood City, CA (US); Robert L. Stewart, Grapevine, TX (US); James R. Yurchenco, Palo Alto, CA (US)

(73) Assignee: Steelcase Inc., Grand Rapids, MI (US)

( * ) Notice: Subject to any disclaimer, the term of this patent is extended or adjusted under 35 U.S.C. 154(b) by 500 days.

(21) Appl. No.: 11/445,552

(22) Filed: Jun. 2, 2006

(65) Prior Publication Data

US 2007/0278838 A1 Dec. 6, 2007

(51) Int. Cl.
*A47C 7/54* (2006.01)

(52) U.S. Cl. ..... 297/411.38; 297/411.36; 297/411.46

(58) Field of Classification Search ..... 297/411.46, 297/411.38, 411.35, 411.34, 411.32, 411.3, 297/411.2, 116, 224, 227, 228; 248/118
See application file for complete search history.

(56) References Cited

U.S. PATENT DOCUMENTS 156,177 A 10/1874 Schabel et al.
177,050 A 5/1876 Wood
229,225 A 6/1880 Young
248,919 A 11/1881 Crosgrave
415,232 A 11/1889 Warner
444,719 A * 1/1891 Zapp ..... 297/116
468,930 A 2/1892 Oulton
477,421 A 6/1892 Jaekel
479,071 A 7/1892 Holstein
518,626 A 4/1894 Pomeroy
560,547 A 5/1896 Shotwell
569,679 A 10/1896 Stokes
583,136 A 5/1897 Anderson
612,816 A 10/1898 Brilliant
685,371 A 10/1901 Davis et al.
722,855 A 3/1903 Koehn
803,826 A 11/1905 Holmes et al.
863,874 A 8/1907 Rajner
955,094 A 4/1910 McNeel (Continued)

FOREIGN PATENT DOCUMENTS

CA 722004 11/1965

(Continued)

*Primary Examiner*—Milton Nelson, Jr.
(74) *Attorney, Agent, or Firm*—Price, Heneveld, Cooper, DeWitt & Litton, LLP

(57) ABSTRACT

A chair for offices and the like includes at least one armrest that can be folded from a generally upright position to a folded position and visa-versa. The folding mechanism has a thin profile, thereby minimizing the thickness of the armrest and providing an aesthetically pleasing appearance. A cover for the armrest includes an elastic material that stretches to accommodate folding, and also contracts to reduce or eliminate wrinkles. The folding mechanism may bias the armrest to the folded position to overcome forces generated by stretching of the cover when the armrest is folded.

12 Claims, 13 Drawing Sheets

U.S. PATENT DOCUMENTS

| | | | | |
|---|---|---|---|---|
| 1,084,111 | A | | 1/1914 | Rolfson-Schmidt |
| 1,157,351 | A | | 10/1915 | Weber |
| 1,233,218 | A | | 7/1917 | Gent |
| 1,336,062 | A | | 4/1920 | Arton |
| 1,348,813 | A | | 8/1920 | Landine |
| 1,350,360 | A | | 8/1920 | Crane |
| 1,357,740 | A | | 11/1920 | Stephan |
| 1,424,302 | A | | 8/1922 | Helms |
| 1,435,960 | A | | 11/1922 | Glocker |
| 1,558,301 | A | | 10/1925 | Sims |
| 1,717,568 | A | | 6/1929 | Koenigkramer |
| 1,825,909 | A | | 10/1931 | Levi |
| 1,842,208 | A | | 1/1932 | Schneider |
| 1,855,130 | A | | 4/1932 | Appleby |
| 1,922,502 | A | | 8/1933 | Scragg |
| 1,925,246 | A | | 9/1933 | Hayes |
| 1,993,437 | A | | 3/1935 | Ferguson |
| 2,064,839 | A | | 12/1936 | Kroll et al. |
| 2,217,426 | A | | 10/1940 | Zareko |
| 2,258,488 | A | | 10/1941 | Gaverth |
| 2,452,642 | A | | 11/1948 | Ewing |
| 2,523,452 | A | | 9/1950 | Shively |
| 2,531,045 | A | | 11/1950 | Hoffman |
| 2,652,101 | A | | 9/1953 | Samsky et al. |
| 2,790,485 | A | * | 4/1957 | Franklin ..... 297/116 |
| 2,854,677 | A | | 10/1958 | Baker et al. |
| 2,858,876 | A | | 11/1958 | Woodson, Jr. |
| 2,897,000 | A | | 7/1959 | Hart et al. |
| 2,931,052 | A | | 4/1960 | Todorovic |
| 3,028,196 | A | | 4/1962 | Kitsopoulos |
| 3,074,762 | A | | 1/1963 | Kris |
| 3,123,396 | A | | 3/1964 | Searle |
| 3,174,799 | A | | 3/1965 | Haltenberger |
| 3,363,939 | A | | 1/1968 | Gross |
| 3,371,956 | A | | 3/1968 | Jordan et al. |
| 3,588,946 | A | | 6/1971 | MacDonald |
| 3,632,161 | A | | 1/1972 | Arfaras et al. |
| 3,712,668 | A | | 1/1973 | Fink |
| 3,751,789 | A | | 8/1973 | Fink |
| 3,779,600 | A | | 12/1973 | Quakenbush |
| 3,950,026 | A | | 4/1976 | Van Seenus |
| 4,108,493 | A | | 8/1978 | Naus |
| 4,145,020 | A | | 3/1979 | Webster |
| 4,159,148 | A | | 6/1979 | Schulz |
| 4,186,456 | A | | 2/1980 | Huempfner |
| 4,215,446 | A | * | 8/1980 | Mahoney ..... 5/425 |
| 4,234,976 | A | | 11/1980 | Litkewycz |
| 4,285,544 | A | | 8/1981 | Zapf |
| 4,297,752 | A | | 11/1981 | Dick et al. |
| 4,411,471 | A | | 10/1983 | Ponzellini |
| 4,420,186 | A | | 12/1983 | Vogt |
| 4,545,615 | A | * | 10/1985 | Kane ..... 297/287 |
| 4,555,136 | A | | 11/1985 | Dranger |
| 4,576,411 | A | | 3/1986 | Kitamura |
| 4,612,679 | A | | 9/1986 | Mitchell |
| 4,632,459 | A | | 12/1986 | Herschlag |
| 4,655,489 | A | | 4/1987 | Bisbing |
| 4,697,847 | A | | 10/1987 | Herschlag |
| 4,730,869 | A | | 3/1988 | Schumacher |
| 4,844,546 | A | * | 7/1989 | Hanai ..... 297/411.27 |
| 4,848,839 | A | | 7/1989 | Galardo |
| 4,865,387 | A | | 9/1989 | Lipparini et al. |
| 4,902,072 | A | | 2/1990 | Chancellor, Jr. |
| 4,917,438 | A | | 4/1990 | Morgan |
| 4,938,534 | A | | 7/1990 | Tornero |
| 5,050,933 | A | | 9/1991 | Tornero et al. |
| 5,060,899 | A | | 10/1991 | Lorence et al. |
| 5,114,212 | A | | 5/1992 | Verney et al. |
| 5,211,443 | A | | 5/1993 | Kelly |
| 5,222,263 | A | | 6/1993 | Magistretti |
| 5,263,764 | A | | 11/1993 | Laughlin et al. |
| 5,273,490 | A | | 12/1993 | Stewart et al. |
| 5,282,671 | A | | 2/1994 | Funk |
| 5,284,314 | A | | 2/1994 | Misaras et al. |
| 5,328,246 | A | | 7/1994 | Sereboff |
| 5,329,654 | A | | 7/1994 | Sherman |
| 5,364,164 | A | | 11/1994 | Kuranami |
| 5,394,573 | A | | 3/1995 | Laughlin et al. |
| 5,408,710 | A | | 4/1995 | Garman et al. |
| 5,415,461 | A | | 5/1995 | Sakamoto |
| 5,423,596 | A | | 6/1995 | Laughlin et al. |
| 5,490,710 | A | | 2/1996 | Dearing et al. |
| 5,533,234 | A | | 7/1996 | Bizek |
| 5,542,746 | A | | 8/1996 | Bujaryn |
| 5,551,757 | A | | 9/1996 | Glover |
| 5,599,067 | A | | 2/1997 | Schuelke et al. |
| 5,667,277 | A | | 9/1997 | Van De Riet |
| 5,678,897 | A | | 10/1997 | Prestia |
| 5,709,431 | A | | 1/1998 | Horn |
| 5,722,114 | A | | 3/1998 | Lapp, Jr. et al. |
| 5,733,002 | A | * | 3/1998 | Riley et al. ..... 297/224 |
| 5,775,778 | A | | 7/1998 | Riley et al. |
| 5,781,945 | A | | 7/1998 | Scherer et al. |
| 5,795,025 | A | | 8/1998 | Murphy |
| 5,795,026 | A | | 8/1998 | Dral et al. |
| 5,816,649 | A | | 10/1998 | Shields |
| 5,829,839 | A | | 11/1998 | Wilkerson et al. |
| D402,497 | S | | 12/1998 | Holley |
| D402,846 | S | | 12/1998 | Licata et al. |
| 5,853,223 | A | | 12/1998 | Ritt et al. |
| D405,637 | S | | 2/1999 | Licata et al. |
| 5,864,900 | A | | 2/1999 | Landau |
| 5,896,619 | A | | 4/1999 | Koopman |
| 5,931,536 | A | | 8/1999 | Wu |
| 6,039,402 | A | | 3/2000 | Nemoto |
| 6,045,183 | A | | 4/2000 | Weber |
| 6,053,579 | A | | 4/2000 | Nelson et al. |
| 6,106,070 | A | | 8/2000 | Ritt et al. |
| 6,247,733 | B1 | | 6/2001 | Weiland |
| 6,296,309 | B1 | | 10/2001 | Kurtz |
| D451,294 | S | | 12/2001 | Simmons, Jr. et al. |
| 6,474,735 | B1 | | 11/2002 | Carnahan et al. |
| 6,513,877 | B1 | | 2/2003 | Ikeda et al. |
| 6,520,586 | B2 | | 2/2003 | Park |
| 6,523,903 | B1 | | 2/2003 | Rabenhorst |
| 6,547,323 | B1 | | 4/2003 | Aitken et al. |
| 6,553,622 | B2 | | 4/2003 | Maruyama et al. |
| 6,554,364 | B1 | | 4/2003 | Dammermann et al. |
| 6,619,746 | B2 | | 9/2003 | Roslund, Jr. et al. |
| 6,637,812 | B2 | | 10/2003 | Laughlin et al. |
| 6,688,698 | B1 | | 2/2004 | Chou et al. |
| 6,702,386 | B2 | | 3/2004 | Davis et al. |
| 6,705,675 | B1 | | 3/2004 | Eastman et al. |
| 6,755,474 | B2 | | 6/2004 | Magnuson |
| 6,773,072 | B2 | | 8/2004 | Phillips et al. |
| 6,807,711 | B2 | | 10/2004 | Lu |
| 6,824,217 | B1 | | 11/2004 | Wang |
| 6,824,218 | B1 | | 11/2004 | van Hekken |
| D501,331 | S | | 2/2005 | Chen |
| 6,851,754 | B2 | | 2/2005 | Bremner |
| 6,857,700 | B2 | | 2/2005 | Eastman et al. |
| 6,883,871 | B2 | | 4/2005 | Nae et al. |
| 6,886,196 | B2 | | 5/2005 | Nygren et al. |
| 6,908,158 | B2 | | 6/2005 | Willette et al. |
| 6,928,673 | B2 | | 8/2005 | Risk, Jr. |
| 7,004,546 | B1 | | 2/2006 | Thisius et al. |
| 7,021,717 | B2 | | 4/2006 | Gaylord et al. |
| D572,490 | S | * | 7/2008 | Overthun et al. ..... D6/334 |
| 2002/0109379 | A1 | | 8/2002 | Marechal et al. |
| 2003/0008587 | A1 | | 1/2003 | Chen |
| 2005/0093358 | A1 | | 5/2005 | Matern et al. |

2005/0146191 A1 7/2005 Machael et al.

FOREIGN PATENT DOCUMENTS

| | | | |
|---|---|---|---|
| DE | 83331697 | | 4/1984 |
| DE | 20120427 | U1 | 5/2002 |
| DE | 20205863 | U1 | 9/2002 |
| EP | 0121899 | A2 | 10/1984 |
| EP | 0212434 | | 3/1987 |
| GB | 708329 | | 5/1954 |
| GB | 2292518 | A | 2/1996 |
| JP | 406022828 | A | 2/1994 |
| JP | 409215549 | A | 8/1997 |
| JP | 144267 | A | 5/2003 |

* cited by examiner

CHAIR WITH FOLDING ARMREST

BACKGROUND OF THE INVENTION

Various armrest arrangements have been developed for office chairs and the like. Existing armrests typically include a support surface configured to support a user's forearms. The support surfaces may be adjustable to provide fore-aft movement/adjustment, side-to-side movement/adjustment, vertical movement/adjustment, and/or rotation/adjustment about a generally vertical axis. Although known adjustable armrest arrangements do provide some degree of adjustment to accommodate different users and/or differing needs of an individual user, known armrest arrangements generally limit the user to one mode of use or variations thereof. Also, known adjustable armrests often include a padded upper portion that is covered with fabric, polymer, or other such material, while the armrest support structure may be exposed metal members or the like. This configuration may result in an appearance that is not aesthetically pleasing, and also restricts use of the armrest in that only the upwardly-facing surface of the armrest is padded to provide comfort for a user.

SUMMARY OF THE INVENTION

One aspect of the present invention is a chair including a base configured to support the chair on a floor surface in a generally upright position. The chair also includes a user support structure extending upwardly from the base, and including a generally upright backrest and a seat portion having a generally horizontal upper seating surface. The chair further includes at least one folding armrest including an upwardly-extending armrest structure including a lower portion secured to the user support structure, and an upper portion pivotably connected to the lower portion at at least one pivot for rotating movement in first and second rotational directions between a generally upright position wherein the upper portion of the armrest structure extends upwardly from the lower portion of the armrest structure, and a folded position wherein the upper portion extends downwardly from the at least one pivot alongside of the lower portion. A releasable catch mechanism selectively retains the upper portion in the upright position. The releasable catch mechanism includes a first catch having a first catch surface, and a second catch having a second catch surface. At least the first catch surface is movable relative to the second catch surface between an engaged position wherein the first and second catch surfaces are in engagement and the first and second catches substantially prevent pivoting movement of the upper portion of the armrest structure relative to the lower portion of the armrest structure in at least the first rotational direction, and a disengaged position wherein the first and second catches permit pivoting movement of the upper portion of the armrest structure relative to the lower portion of the armrest structure in at least the first rotational direction. The first catch comprises a flexible member having a base portion fixed to the armrest structure, and a resiliently deformable portion that is deformed when the first catch surface is in the disengaged position and biases the first catch surface into the engaged position.

Another aspect of the present invention is an armrest for chairs including an internal armrest structure having an upper part that is pivotably connected to a lower part for movement between an upright position and a folded position. A cover extends over the upper and lower parts of the internal armrest structure. At least a portion of the cover is made of a material having an elastic foam layer defining first and second side surfaces, wherein at least one of the first and second side surfaces is at least partly covered with a layer of stretchable fabric.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
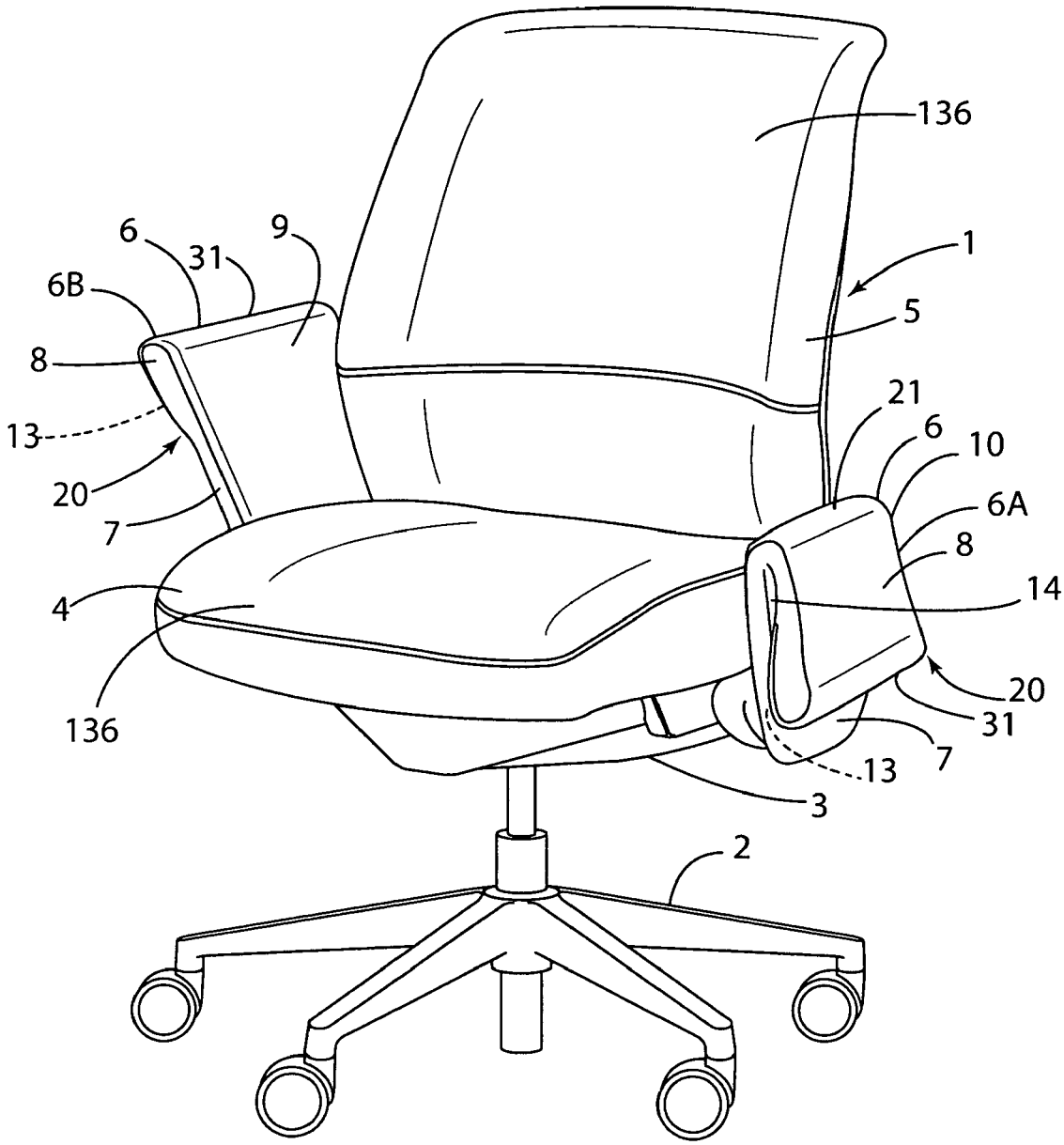
FIG. 1 is a perspective view of a chair including at least one folding armrest according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

A chair 1 includes a suitable support structure such as base 2 that is configured to support the chair 1 on a floor surface, and a support structure 3 that supports the seat 4 and back 5. The base 2, support structure 3, seat 4 and back 5 may be constructed according to a wide variety of known designs.

Figure 2:
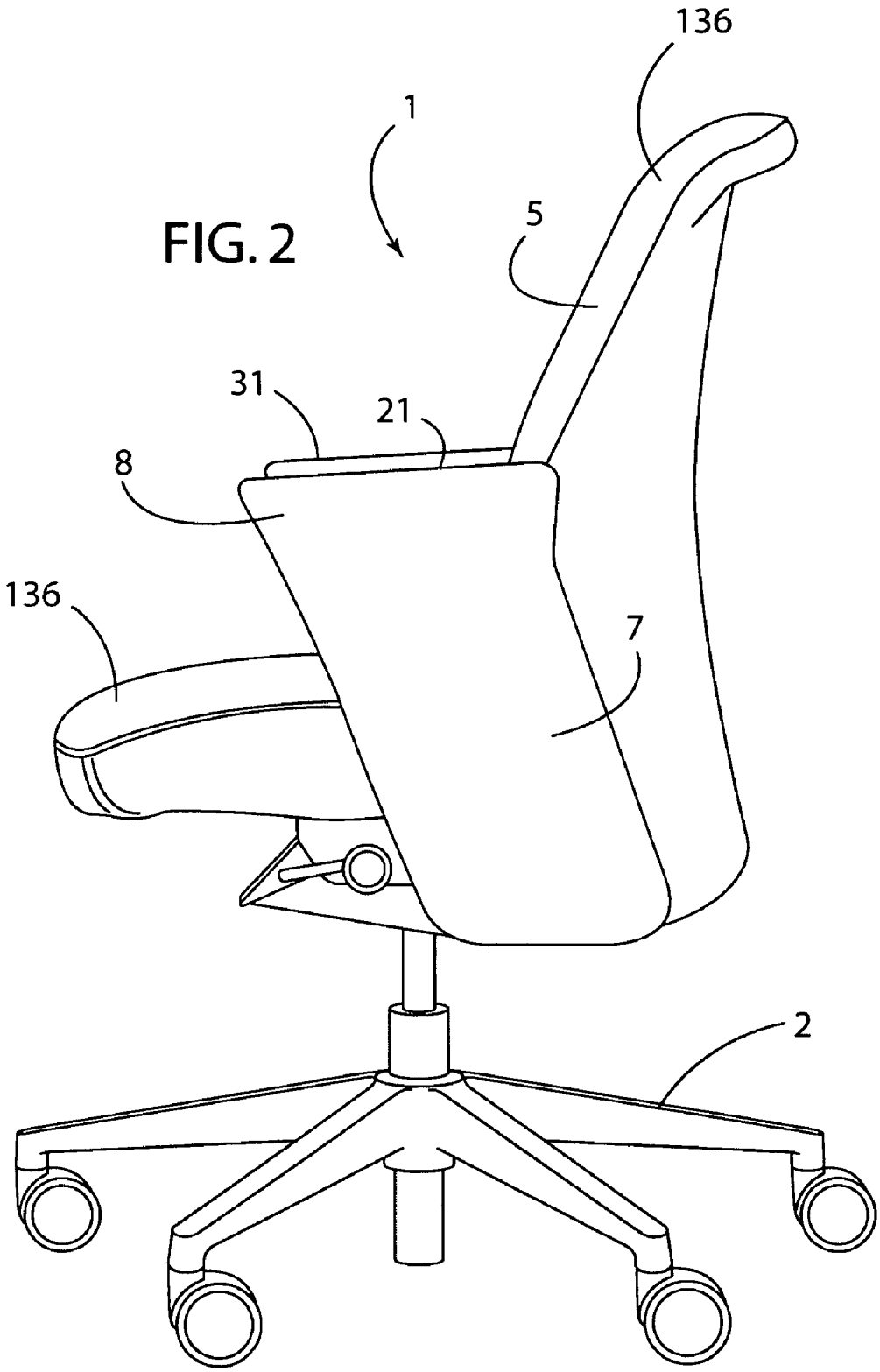
FIG. 2 is a side view of the chair of FIG. 1 with both armrests in the upright position.

The chair 1 further includes a pair of armrests 6, each of which includes a lower portion 7 and an upper portion 8 that is pivotably connected to the lower portion 7 at a junction or pivot 10, such that the upper portions 8 can be folded downwardly about pivot 10 into the configuration designated "6A" in FIG. 1. When the armrests 6 are in a substantially upright use position designated "6B", the upper portion 8 of each armrest 6 is generally aligned with lower portion 7, such that the inner surfaces 9 of armrests 6 are relatively flat, and extend vertically upward, or at a relatively small angle relative to vertical. In the illustrated example, the upper and lower portions of armrests 6 extend outwardly at a small angle of about 6 degrees relative to a vertical plane. However, when upper portion 8 of armrest 6 is folded down to the configuration designated 6A, upper portion 8 extends downwardly from pivot 10. In the folded configuration 6A, upper portion 8 of armrest 6 is generally parallel to lower portion 7, with outer surface 13 (see also FIG. 2) of upper portion 8 of armrest 6 in contact with, or close proximity to outer surface 14 of lower portion 7 of armrest 6.

When one of the armrests 6 is in the folded position 6A, and the other armrest 6 is in the upright position 6B as shown in FIG. 1, a user can position a leg or legs over the folded armrest 6A, and thereby sit or recline in chair 1 in a mode that is different or impossible in chairs having conventional armrests. Also, each armrest 6 is covered with a cover or "sock" 20 providing a smooth outer surface 21 in the area of junction 10 when armrest 6 is in folded position 6A. As discussed in more detail below, cover 20 is made of a stretchable material that permits armrests 6 to fold into the folded position 6A without wrinkling or excessive binding, such that the folded armrests 6 have relatively smooth outer surfaces in both the folded and upright configurations. As also discussed in more detail below, covers 20 are not only stretchable, but covers 20 also provide cushioning to further promote comfort for a user. The stretchability of cover 20 further ensures that the inner surface 9 do not wrinkle when armrests 6 are in the upright position 6B, to thereby not only provide a comfortable surface for a user, but also provide an aesthetically pleasing appearance. Also, armrests 6 have a relatively thin cross-sectional construction to provide an aesthetically pleasing appearance, and also permit upper portion 8 to be folded closely against lower portion 7 when armrest 6 is in the folded configuration 6A.

Figure 3:
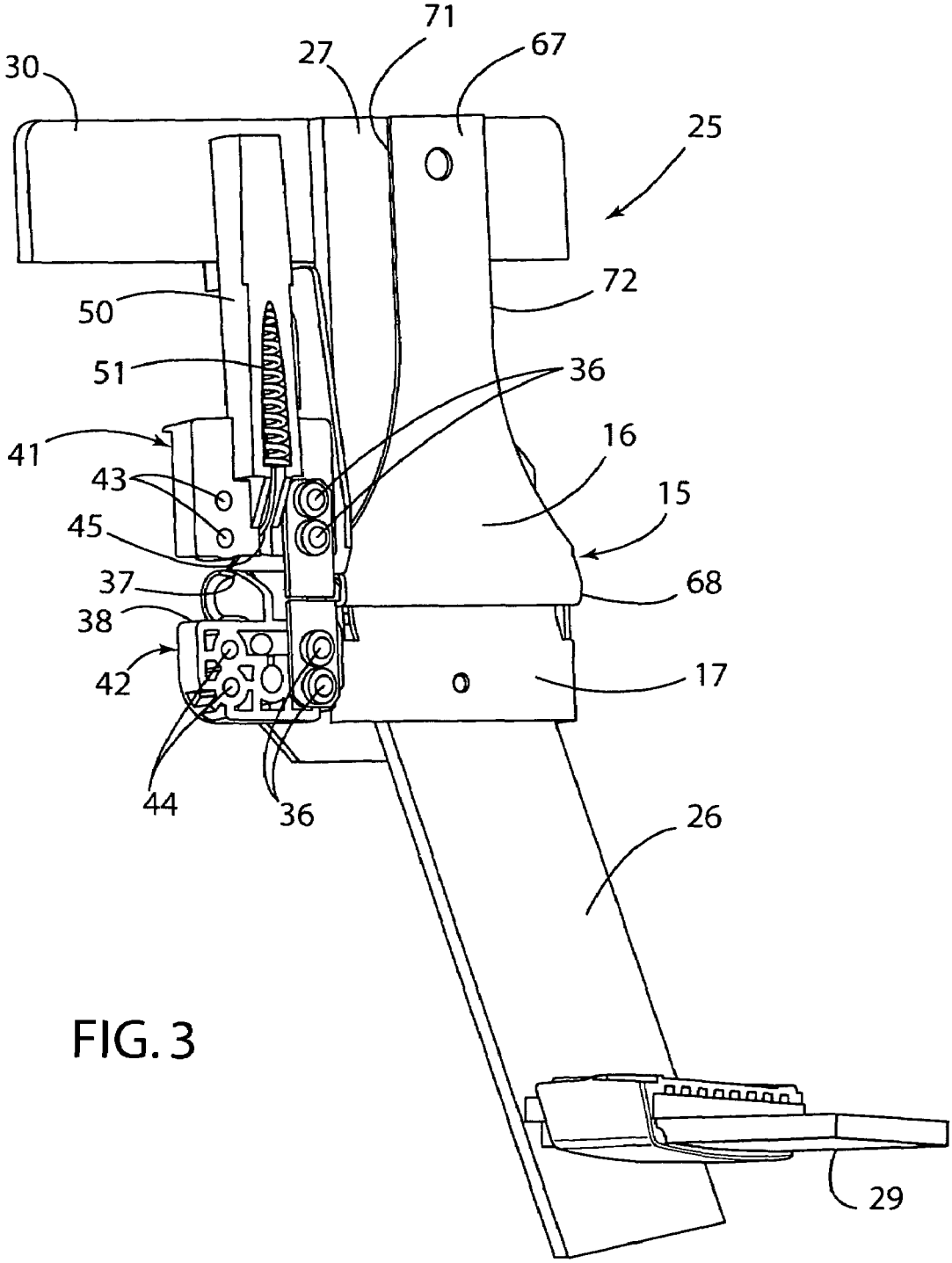
FIG. 3 is a perspective view of the internal armrest structure of the chair of FIG. 1.
Figure 4:
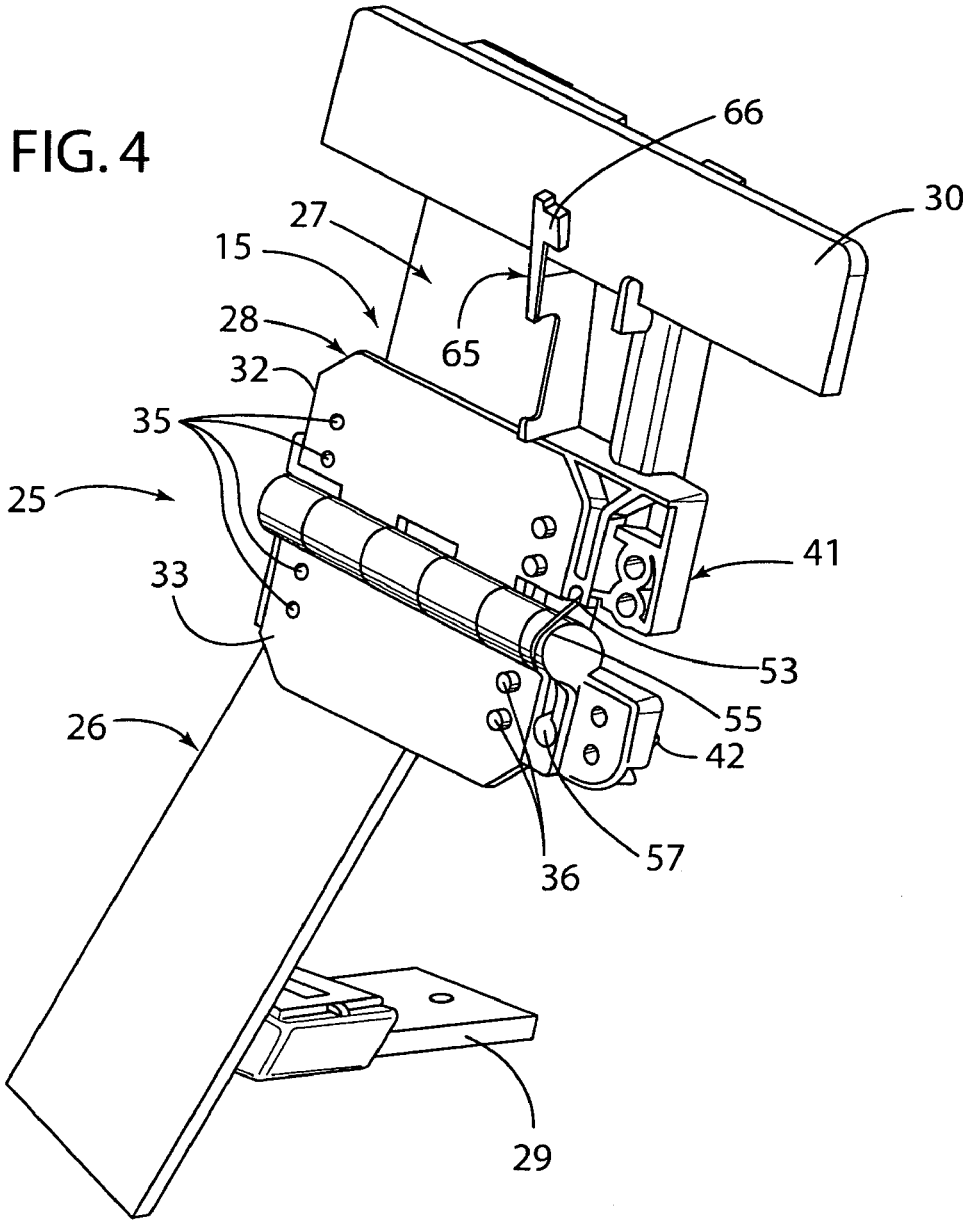
FIG. 4 is a perspective view of the internal armrest structure of the chair of FIG. 1 from a different angle.

With further reference to FIGS. 3 and 4, internal armrest structure 25 of right armrest 6 includes an upwardly extending lower structural member 26, and an upper structural member 27 that is pivotably connected to the lower structural member 26 via at least one hinge 28. Left and right armrests 6 are mirror images of one another and it will therefore be understood that descriptions of one of the armrests 6 generally applies to the other armrest 6 as well, and only one of the armrest 6 will therefore be described herein. Hinge 28 provides for pivoting movement of upper structural member 27 between the upright position 6B (FIG. 1) and the lower, folded position 6A. As discussed in more detail below, a releasable latch mechanism 15 retains the armrest 6 in the upright position unless the latch mechanism 15 is released by a user. A structural connector 29 extends from lower structural member 26, and rigidly interconnects the internal armrest structure 25 to the support structure 3 of chair 1. An upper cross member 30 is welded or otherwise secured to upper structural member 27 to provide support for armrest 6 in the vicinity of upper surface 31 (FIG. 1) of armrest 6.

Figure 5:
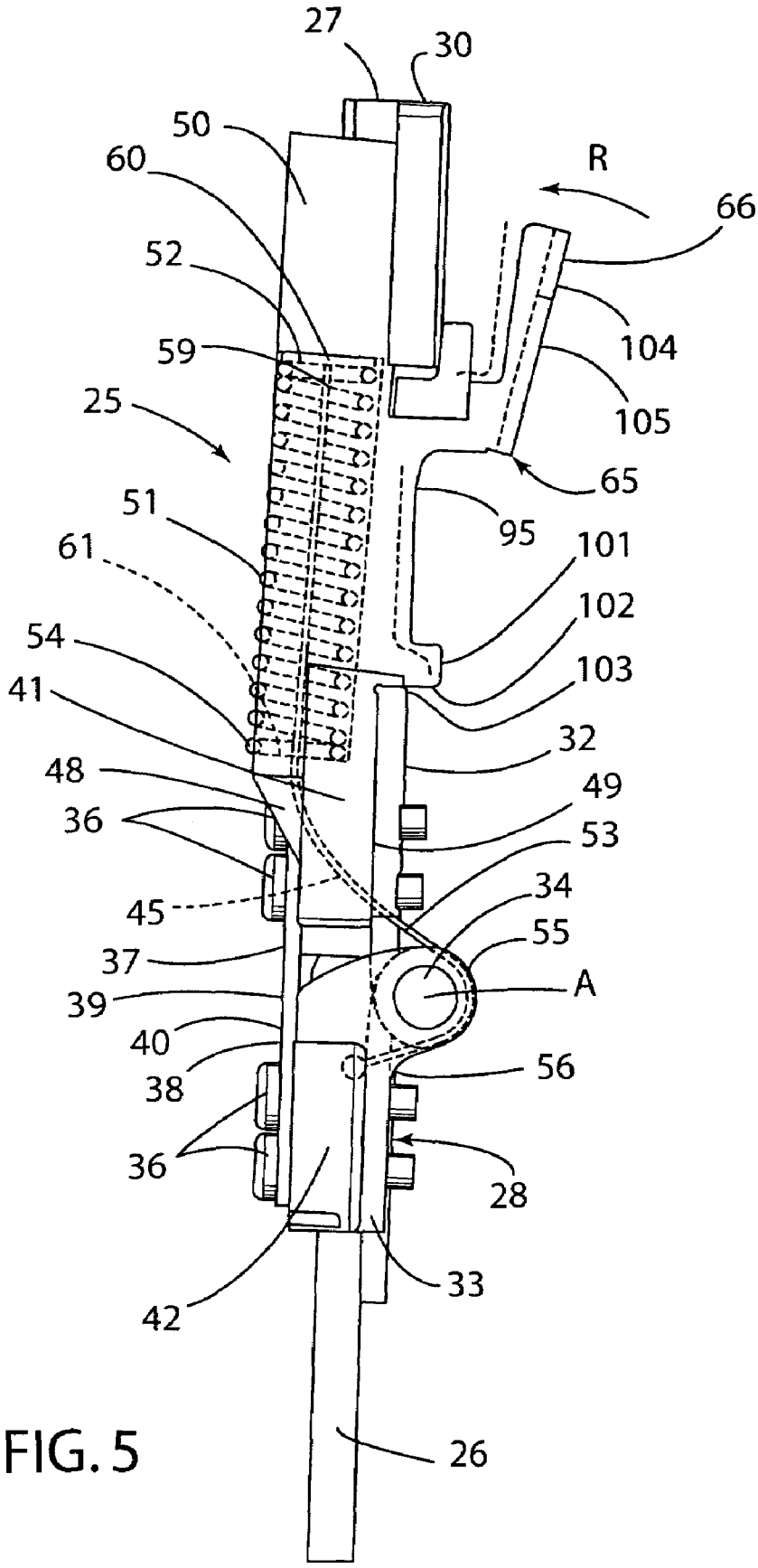
FIG. 5 is a side view of the internal armrest structure.

Hinge 28 includes a first hinge plate 32 and a second hinge plate 33 that are pivotably connected by a hinge pin 34 (see also FIG. 5). A plurality of openings 35 in hinge plates 32 and 33 receive threaded fasteners 36 to secure stop members 37 and 38 to hinge plates 32 and 33, respectively, and also to secure upper spring perch/cable guide 41 and lower cable guide 42 to hinge plates 32 and 33, respectively. Edge 39 (FIG. 5) of stop member 37 contacts edge 40 of lower stop member 38 to limit rotation of upper structure 27 relative to lower structural member 26. As shown in FIG. 5, the stop members 37 and 38 are offset relative to axis of rotation "A" of hinge 28 to prevent rotation of upper structural member 27 beyond the upright position (FIG. 5) wherein upper structural member 27 is substantially aligned with lower structural member 26.

Referring again to FIGS. 3 and 4, upper cable guide 41 is positioned between stop member 37 and hinge plate 32, and lower cable guide 42 is positioned between stop member 38 and hinge plate 33. Upper cable guide 41 includes four openings 43, and lower cable guide 42 includes four openings 44. Upper cable guide 41 and lower cable guide 42 are symmetrical about their center lines, and can thereby be used for right-hand and left-hand armrests 6. The hinge plates 32 and 33 include four threaded openings 35 to accommodate threaded fasteners 36 for both right-hand and left-hand armrests 6. Stop members 37 and 38 can also be mounted on either side of hinge plates 32 and 33 and upper and lower cable guides 41 and 42 for use in both left- and right-hand armrests 6. In this way, the number of parts that are needed to fabricate a pair of armrests 6 for chair 1 is substantially reduced.

With reference to FIGS. 3 and 5, upper cable guide 41 includes a curved groove 45 that extends from a first side 48 of cable guide 41 to a second side 49 of cable guide 41. Upper cable guide 41 also includes an upper section 50 having a generally tubular construction to house a coil spring 51. A cable 53 extends from an upper end 52 of coil spring 51 through the coil spring 51 and tubular upper section 50 of upper cable guide member 41, and extends in curved groove 45 from a first side 48 of upper cable guide member 41 to a second side 49 of upper cable guide member 41. The cable 53 also extends along a curved groove 55 in lower cable guide 42, and a ball end 56 at first end 58 of cable 53 is connected to a "keyhole" connector 57 in lower cable guide member 42. Second end 59 of cable 53 is connected to a fitting 60 that bears against end 52 of coil spring 51. Lower end 54 of coil spring 51 is seated against a surface 61 on the inside of upper tubular section 50 of upper cable guide member 41.

When the upper structural member 27 is in the upright position relative to lower structural member 26 (FIG. 5), coil spring 51 is compressed to thereby tension cable 53. Due to the position of cable 53 as it extends along cable guides 41 and 42 and also between cable guides 41 and 42, the tension of cable 53 biases the upper structural member 27 towards the folded configuration (i.e., counter-clockwise relative to lower structural member 26 in FIG. 5). As described in more detail below, cover 20 of armrest 6 is made of a resilient, stretchable material that tends to generate a bias tending to rotate upper portion 8 of armrest 6 to the upright position 6B (FIG. 1). The bias towards the folded position 6A due to coil spring 51 and cable 53 overcomes the bias due to stretching of armrest cover 20, thereby ensuring that the upper portion 8 of armrest 6 stays in a tightly folded configuration 6A without use of a mechanical latch or the like. Also, the bias provided by coil spring 51 and cable 53 assist a user folding the armrest 6, and reduces the force that would otherwise be required to fold the armrest 6. It will be appreciated that the bias provided by coil spring 51 and cable 53 is preferably greater than the bias caused by stretching of cover 20 to retain the armrest 6 in the folded configuration 6A, but the bias generated by coil spring 51 and cable 53 is not so large as to make it difficult for a user to move the upper portion 8 of armrest 6 from the folded position 6A to the upright position 6B. In the illustrated example, the bias provided by spring 51 and cable 53 is sufficient to move and/or retain the armrest in a fully folded position if latch mechanism 15 is released. The cable guide members 41 and 42 are made of a polymer material to facilitate formation of the grooves 45 and 55, and other features of the cable guides 41 and 42. However, a variety of other materials could also be utilized to construct the cable guides 41 and 42.

Figure 6:
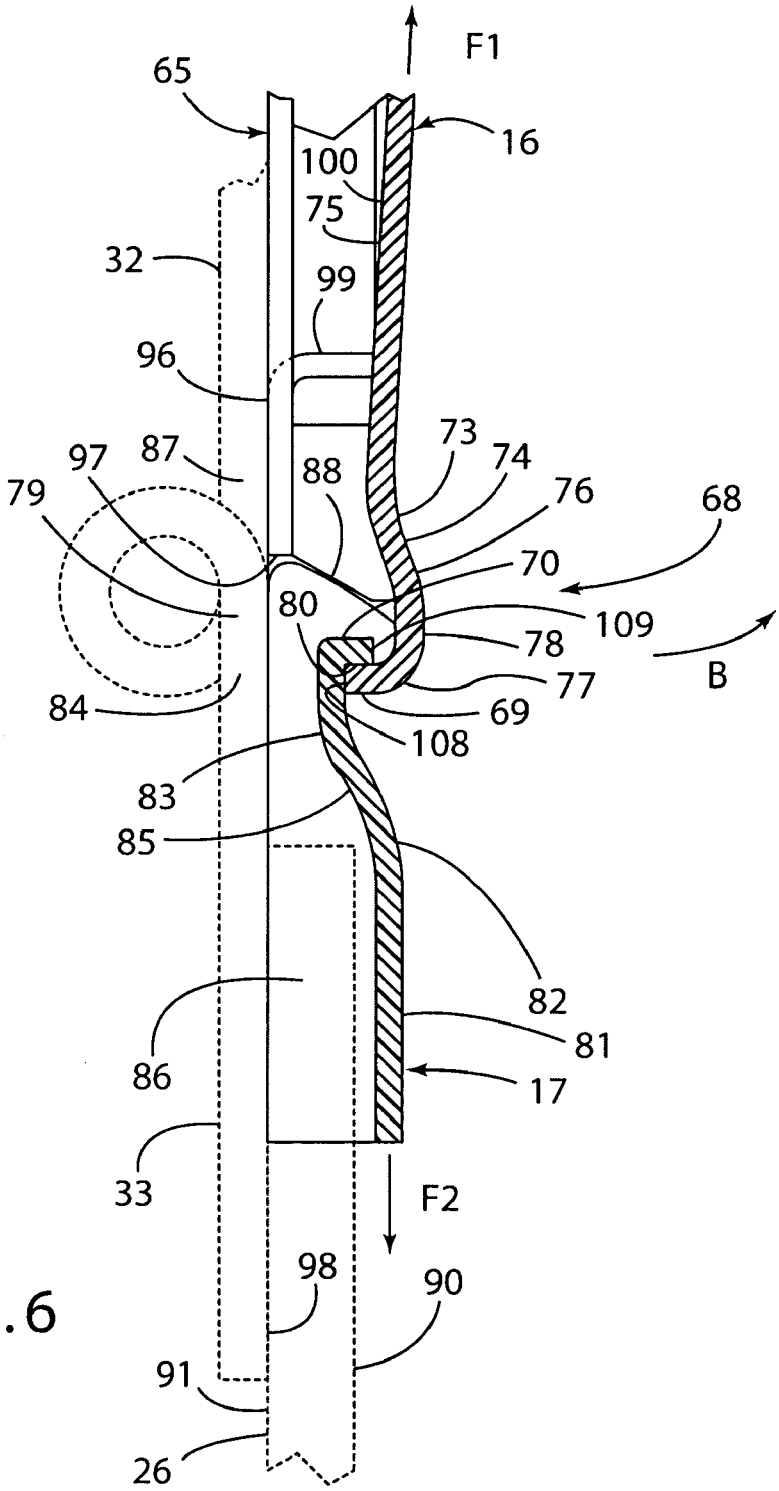
FIG. 6 is a fragmentary cross-sectional view showing the engagement of the first and second latch members.

With reference back to FIG. 3, latch mechanism 15 retains or locks the upper armrest structure 27 in the upright position unless a user releases the latch mechanism 15 by pushing on upper end 66 (FIG. 5) of actuator member 65. Latch mechanism 15 includes a first latch member 16 that can be engaged with a second latch member 17. First latch member 16 has a first end 67 that is welded or otherwise secured to upper structural member 27, and a second end 68 having a lip or catch 69 (see also FIG. 6) that engages a lip or catch 70 of second latch member 17 when latch mechanism 15 is in the latched configuration.

Referring again to FIG. 3, first end portion 67 of first latch member 16 is relatively narrow, and edges 71 and 72 taper apart at second end 68 of first latch member 16, such that second end 68 is substantially wider than first end 67. The lower end 68 of first latch member 16 is not secured to upper structural member 27, such that lower end 68 can be moved away from second latch member 17 in the direction of the arrow "B" (FIG. 6) by bending/flexing of first latch member 16. Although, first latch member 16 is somewhat flexible in bending, it is quite stiff when axial forces "F1" and "F2" are applied. Such forces occur when a force tending to rotate the upper portion 8 of armrest 6 to the folded position 6A is applied to the armrest 6. End 68 of first latch member 16 is bent at bend line 73 to form a portion 74 that extends at an angle relative to upper portion 75. Bend lines 76 and 77 form portions 78 and lip or catch 69. Lip or catch 69 forms a first latch surface 79 that contacts a second latch surface 80 formed by lip or catch 70 of second latch member 17. The shape of latch member 16 provides for a latch mechanism 15 having a very thin overall construction, thereby permitting armrest 6 to have a thin cross-section to provide an aesthetically pleasing appearance, yet still have substantial strength and stiffness with respect to rotational forces applied to armrest 6 tending to move the armrest to the folded configuration. In the illustrated example, first latch member 16 is made from a sheet of steel having a generally uniform thickness.

Second latch member 17 is also made of a relatively thin steel sheet material, and includes a web 81, and bend lines 82, 83 and 84 that form lip or catch 70. The shape of second latch member 17 provides a thin cross-sectional configuration for the latch mechanism 15. Second latch member 17 includes a pair of webs 86 that extend transversely from web 81. End portions 87 of webs 86 include a tapered edge 88, and a transverse edge 89. As described in more detail below in connection with FIG. 10, the tapered edge 88 contacts lip 69 of first latch member 16 as the upper portion 8 of armrest 6 is rotated to the upright position, and the tapered edges 88 thereby bend or flex first latch member 16 to provide for latching of latch mechanism 15 as it is rotated to the upright configuration.

Referring again to FIG. 6, lip 69 of first latch member 16 may be bent somewhat beyond ninety degrees to form a hook-shape with lip 69 and latch surface 79 disposed at an acute angle relative to a force F1 acting on latch member 16. Similarly, lip or catch 70 of second latch member 17 may also be bent beyond ninety degrees to form a hook-shape with lip 70 and latch surface 80 disposed at an acute angle relative to a force F2 acting on latch member 17. In the illustrated example, the lips 69 and 70 extend at an angle that is about eight to ten degrees less than ninety degrees. This angle tends to cause lips 69 and 70 to become more securely engaged when forces F1 and F2 are applied due to an external force tending to fold the armrest that is applied to the armrest. Also, as discussed above, spring 51 and cable 53 generate a force biasing the armrest to the folded position. This biasing force pulls on latch members 16 and 17, causing lips 69 and 70 to be tightly engaged, even if no external force is applied to the armrest. The tight engagement due to the angle of lips 69 and 70 and the bias of spring 51/cable 53 ensures that latch mechanism 15 is not inadvertently disengaged. Also, as discussed in more detail below, if an external force tending to fold the armrest is applied to the armrest when it is in the latched configuration, the latch will remain latched even if a user pushes on actuator member 65. When assembled, web 81 of second latch member 17 is welded or otherwise secured to first side surface 90 of lower structural member 26, and structural member 26 is positioned between the side webs 86 of second latch member 17. Also, as discussed above, second hinge plate 33 is welded or otherwise secured to second side surface 91 of lower structural member 26.

Figure 7:
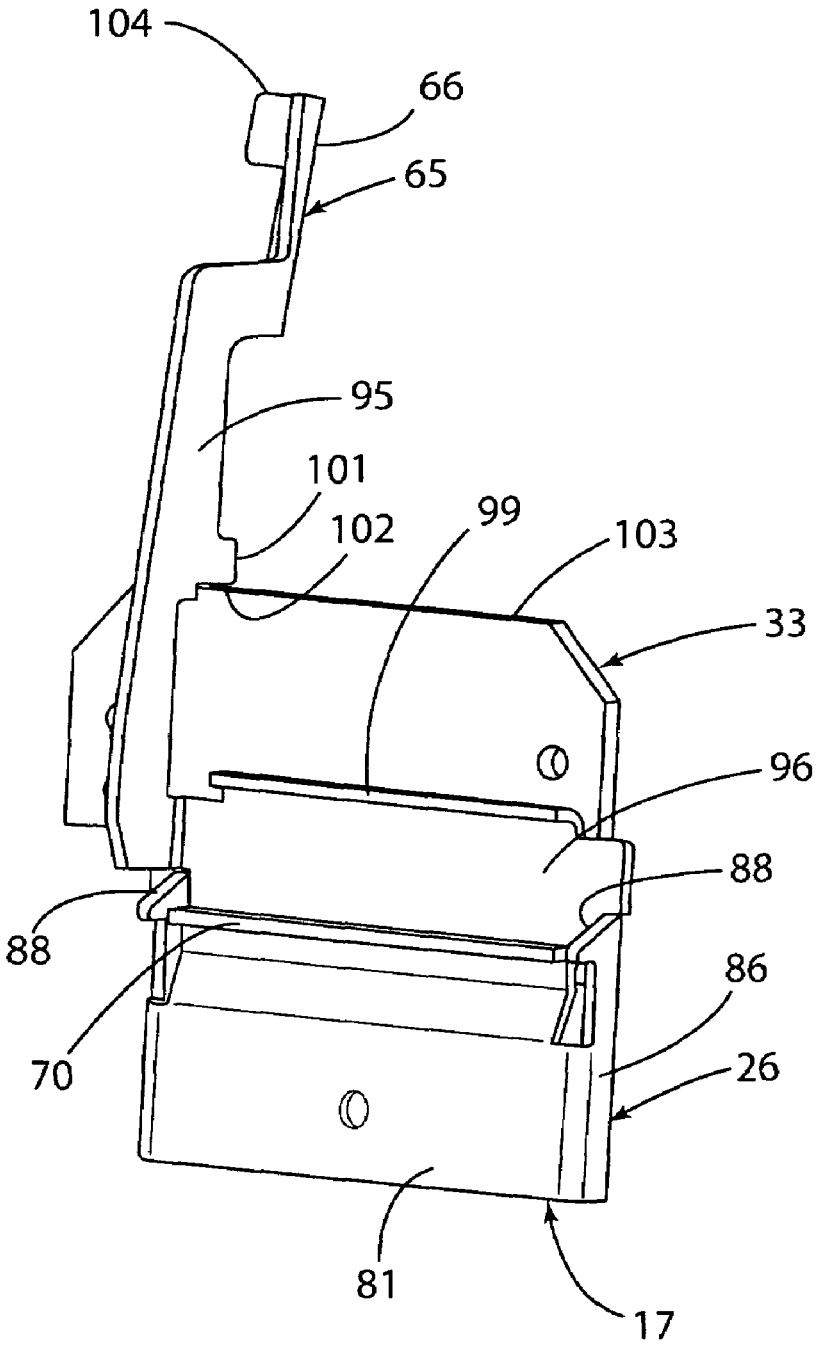
FIG. 7 is a perspective view of a portion of the latch mechanism.

With further reference to FIG. 7, actuator member 68 includes an elongated portion 95 forming a lever. A web 96 extends transversely from the elongated portion 95, and lower edge 97 (FIG. 6) of web 96 contacts inner surface 98 of second hinge plate 33. A lip or flange 99 extends away from web 96 towards inner surface 100 of first catch member 16. A tab 101 extends from elongated portion 95, and defines a lower edge 102 that contacts an upper edge 103 of second hinge plate 33 (see also FIG. 5) to prevent the actuator member 65 from shifting downwardly due to gravitational forces. A tab 104 is formed on a flange 105 at upper end 66 of actuator member 65. When the armrest 6 is assembled, the tab 104 is positioned under cover 20 directly adjacent outer surface 13 (see also FIG. 2) of armrest 6 adjacent upper surface 31.

Figure 8:
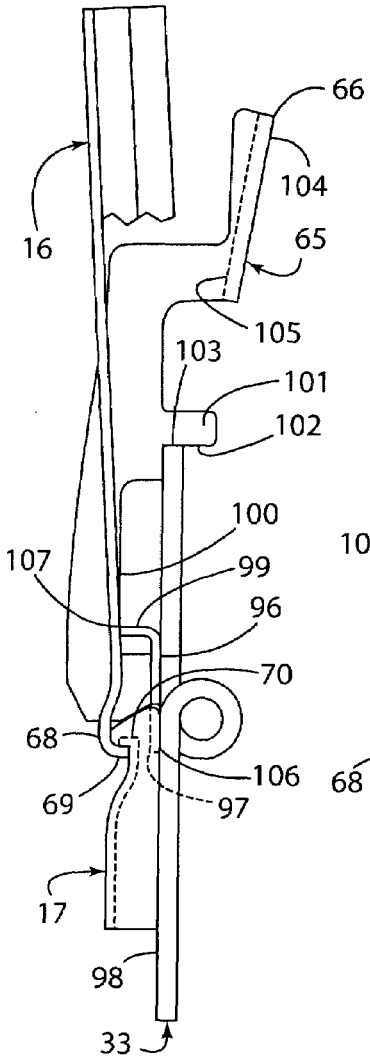
FIG. 8 is a partially fragmentary side view of the latch mechanism, wherein some of the parts are not shown for clarity.
Figure 9:
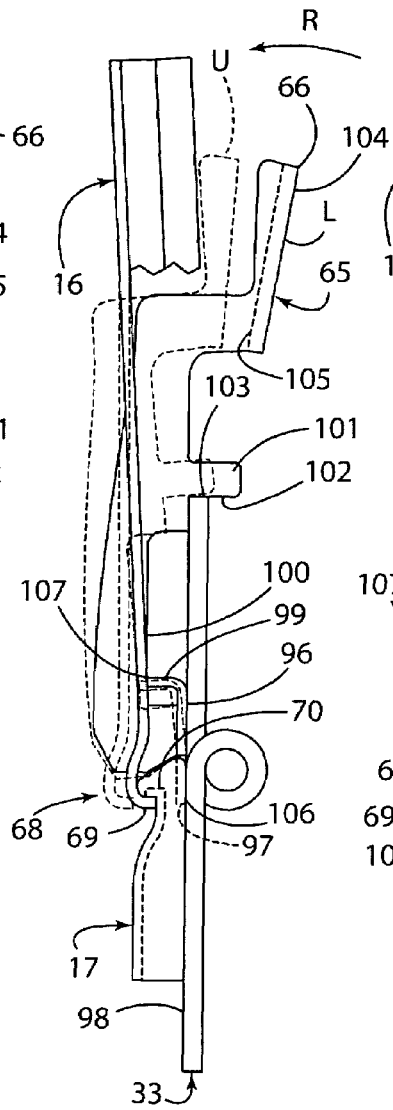
FIG. 9 is a side view of the internal armrest structure of FIG. 8 wherein the latch components are shown in the unlatched position with dotted lines.
Figure 10:
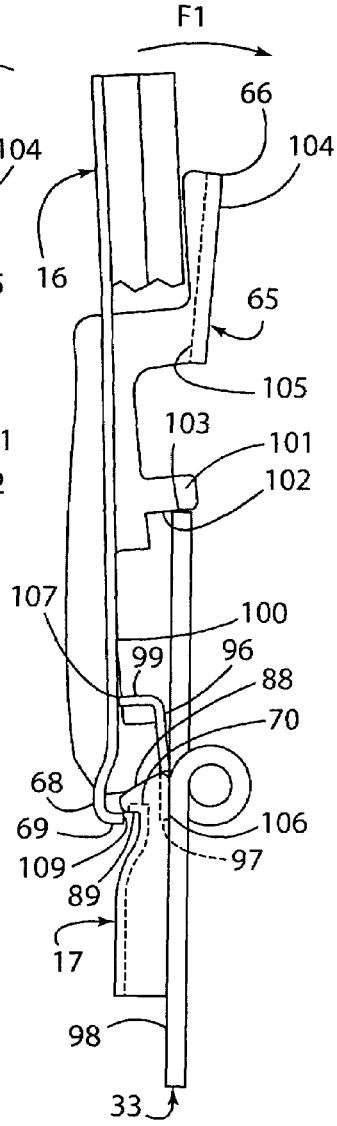
FIG. 10 is an end view of the internal armrest structure of FIG. 8 in the unlatched position.

With further reference to FIGS. 8-10, in use, a user pushes against end 66 of actuator member 65 causing the actuator member 65 to move from the latched position "L" (FIG. 9) to the unlatched "U" shown in dashed lines in FIG. 9. The latch mechanism 15 is shown in the latched position in FIG. 8, and in the unlatched position in FIG. 10. As the actuator member 65 rotates, edge 97 of web 96 of actuator member 65 bears against surface 98 of second hinge plate 33, thereby causing actuator member 65 to rotate about a line of contact 106 where edge 97 contacts surface 98. As actuator member 65 moves from the latched position L to the unlatched position U, edge 107 of lip or flange 99 of actuator member 65 contacts inner surface 100 of first latch member 16 adjacent second end 68 of first latch member 16, and thereby pushes lip or catch 69 of first latch member 16 out of engagement with lip or catch 70 of second latch member 17. Once the edge 108 of first latch member 16 has been moved beyond edge 109 of second latch member 17, first latch member 16 and second latch member 17 are no longer engaged, and the upper portion 8 of armrest 6 can be rotated towards the folded position in the direction of the arrow "F1" (FIG. 10). If, however, an external force tending to fold armrest 6 is being applied to the armrest at the time the user pushes on end 66 of actuator 65, the angles of lips 69 and 70 will cause them to be more tightly engaged, and thereby prevent the lip 69 from disengaging lip 70. In this circumstance, actuator 65 will flex and "bottom out" against another component such as cross member 30 without releasing latch mechanism 15. Furthermore, the angle of lips 69 and 70 of latch members 16 and 17, respectively, may also be selected to prevent disengagement of latch mechanism 15 unless an external force away from the folded configuration is applied to overcome the bias of spring 51 and cable 53 at the same time the end 66 of actuator 65 is pushed inwardly. As discussed above, coil spring 51 and cable 53 bias the upper portion 8 of armrest 6 towards the folded position, and assist the user in overcoming forces generated by stretchable cover 20 as the armrest 6 is moved to the folded position 6A shown in FIG. 1.

Figure 11:
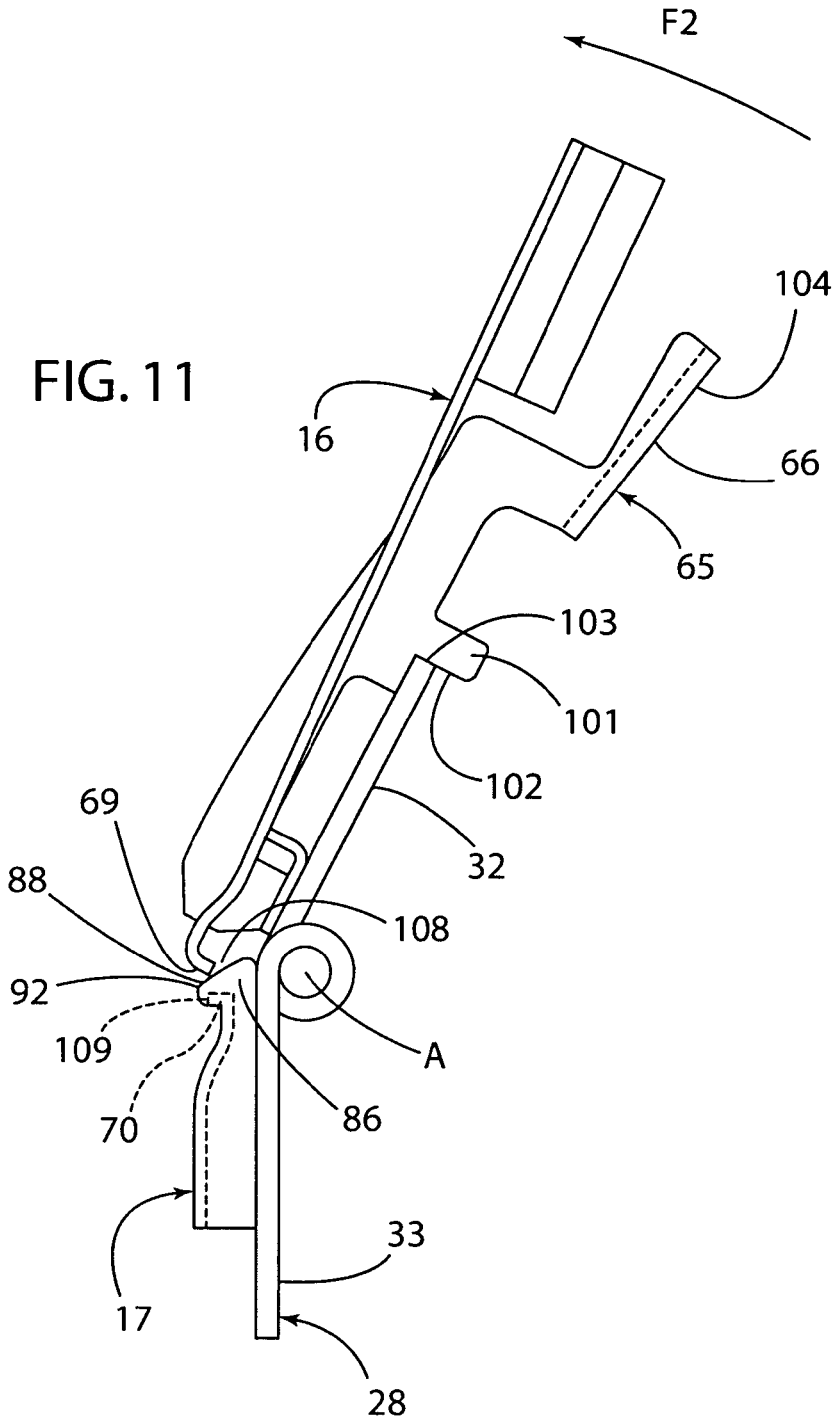
FIG. 11 is a side view of the latch components in an unlatched configuration with the upper portion of the armrest structure rotated to a position that is between an upright use position and a folded use position.

With further reference to FIG. 11, in order to rotate the upper portion 8 of armrest 6 to the upright position from the folded position, a user grasps the upper portion 8 of armrest 6, and rotates the upper portion 8 of armrest 6 in the direction of the arrow "F2". As the upper part of the armrest rotates, edge 108 of lip or catch 69 of first latch member 16 contacts tapered edge 88 of second latch member 17, thereby creating a force on first latch member 16 causing first latch member 16 to flex and move edge 108 of first latch member 16 along tapered edge 88, and end edge portion 92 of side webs 86 of second latch member 17, such that edge 108 of lip or catch 69 of first latch member 16 passes around edge 109 of lip or catch 70 of second latch member 17. When the upper portion 8 of armrest 6 reaches the fully upright position, the bias caused by flexing of first latch member 16 causes lip or catch 69 to move back into the latched position illustrated in FIG. 8.

Figure 12:
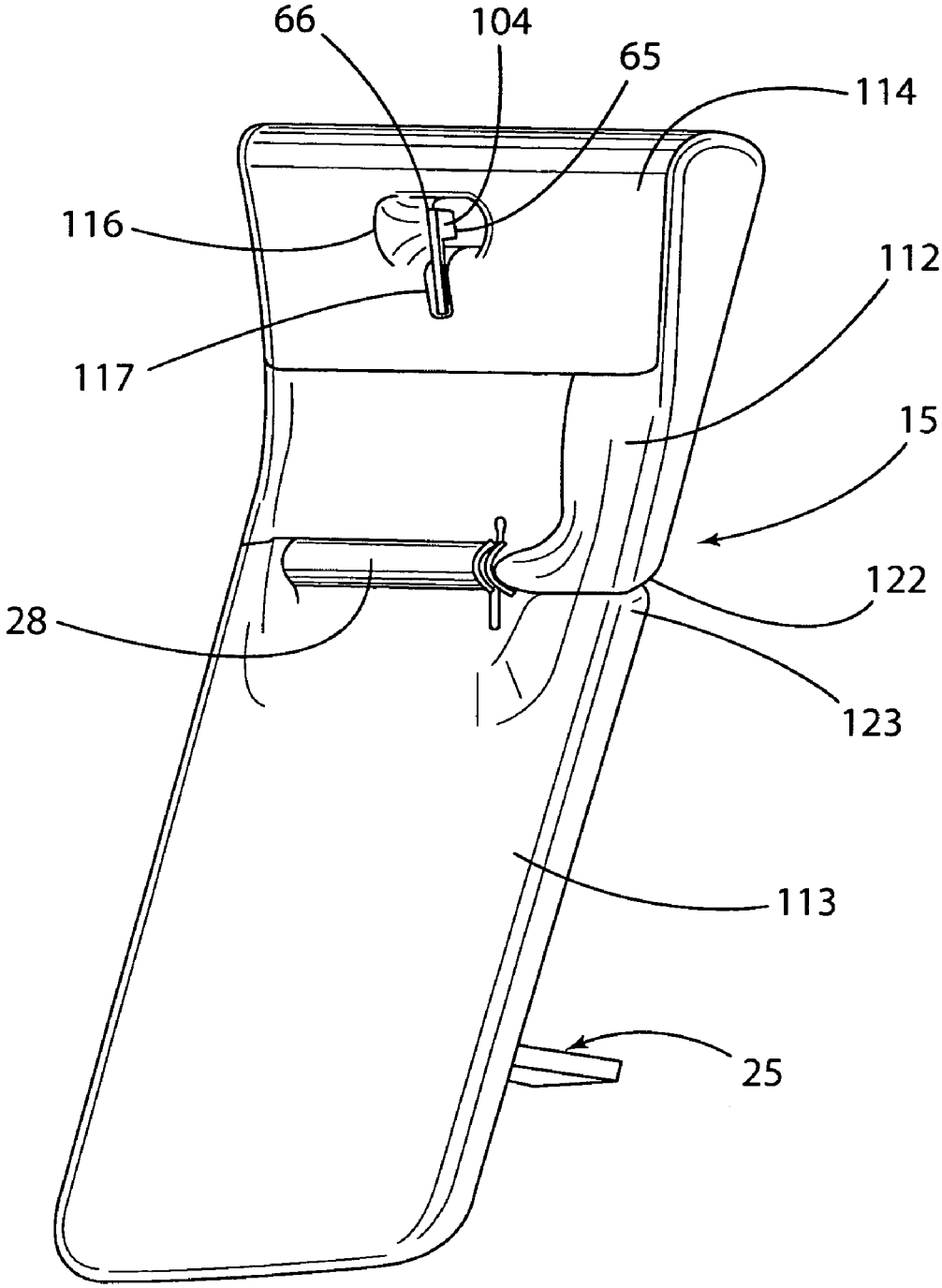
FIG. 12 is a perspective view of the armrest structure, wherein the armrest structure is substantially covered by foam having a generally smooth outer surface.
Figure 13:
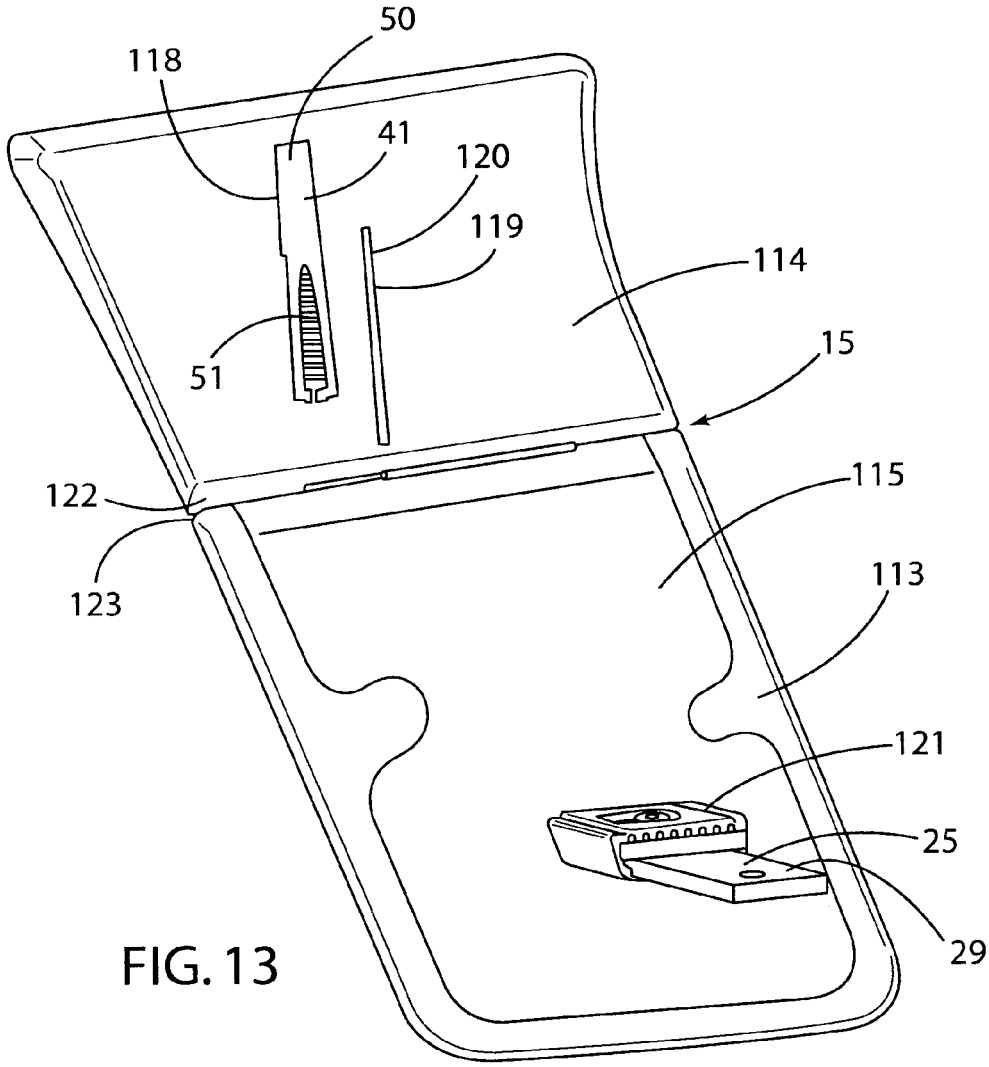
FIG. 13 is the armrest structure from a different angle.

With further reference to FIGS. 12 and 13, internal armrest structure 25 and latch mechanism 15 are covered by pieces of foam 112, 113, 114 and 115 to provide a generally smoothly-contoured surface, and to isolate the cover 20 from the internal armrest structure 25 and latch mechanism 15. As shown in FIG. 12, tab 104 at end 66 of actuator member 65 is disposed in an opening 116 in foam 112, and a slotted portion 117 of opening 116 permits movement of actuator member 65. As shown in FIG. 13, a portion of tubular upper section 50 of spring perch/cable guide 41, and an edge 120 of actuator 65 is received in an opening 119 in foam 114. Similarly, connector 29 extends through an opening 121 in foam 115. Curved surfaces 122 and 123 provide clearance to permit unrestricted rotation of the upper portion of the armrest relative to the lower portion.

Figure 14:
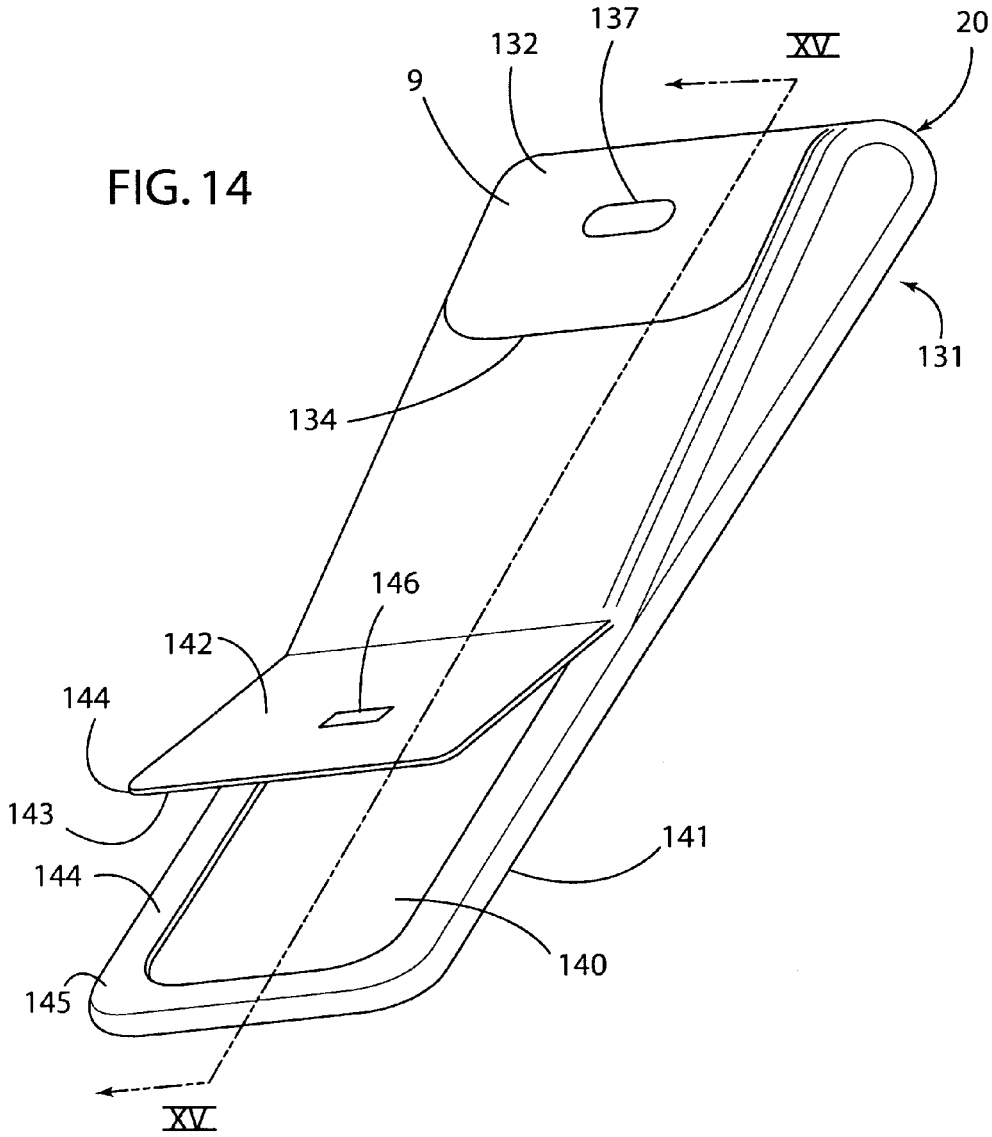
FIG. 14 is a perspective view of a cover for the armrest.
Figure 15:
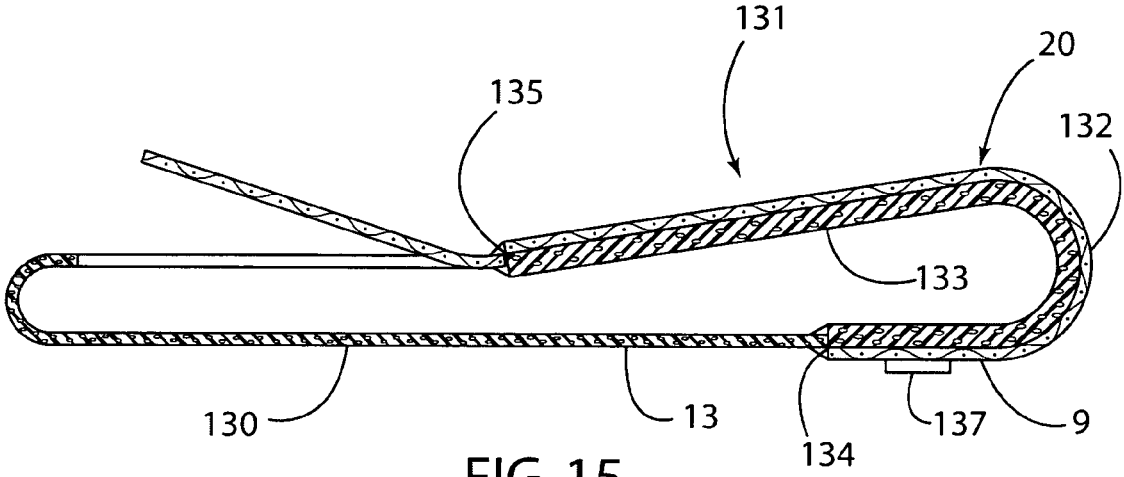
FIG. 15 is a cross-sectional view of the cover of FIG. 14 taken along the line XV-XV.

With further reference to FIGS. 14 and 15, a portion of cover 20 is made of a stretchable neoprene material 130. In the illustrated example, the neoprene material 130 comprises a "CR" (Chloroprene Rubber) foam material having a thickness of about 1.5 mm. Neoprene material 130 has an elongation break percentage of 400%, and the modulus at 200% elongation is in the range of 2-3 kg/cm$^2$. This material includes a stretchable neoprene foam layer with nylon or other stretchable fabric laminated on both sides. A preferred material 130 is made by Perfectex Plus LLC of Huntington Beach, Calif. Although a material having an elongation at break of about 400% minimum is preferred, materials having other material properties are also suitable. For example, materials having an elongation in the range of 300% to 500% may also be used. Also, materials having larger elongation percentages in the range of 600, 700, 800 or more may also be used. It should be noted however, that materials having an elongation percentage in the range of 300% do not provide as great a degree of flexibility, and may hinder rotation of upper armrest portion 8 to the fully folded position 6A shown in FIG. 1. Also, the thickness of material may be greater than or less than 1.5 mm. For example, material in the range of about 0.5 mm to 3.0 mm may be used. Thicker materials having thicknesses of 4 mm, 5 mm, 6 mm, 7 mm, or more may also be utilized. Upper portion 131 of cover 20 includes a fabric outer layer 132, and an inner layer 133 comprising a versare backer. The neoprene material 130 is stitched to the fabric 132 and backer 133 at seams 134 and 135. Outer fabric 132 may be the same fabric 136 utilized to cover the chair back 4 and 5 to thereby provide an integrated appearance for the armrests 6. Also, fabric 132 does not necessarily need to be a stretchable fabric, such that virtually any type of fabric 132 may be utilized on the armrest 6. The neoprene material 130 provides sufficient elasticity to permit the armrest 6 to be moved into the folded position, and the layer of neoprene foam provides a cushioning effect to minimize unsightly wrinkles, and/or hard spots that could otherwise occur along outer surface 21 of armrest 6 due to the latch mechanism 15, hinge 28, or other internal armrest structures and parts. The fabric 132 and backer 133 provide additional cushioning at outer surface 21 (FIG. 1) to provide a comfortable surface for a user when the armrest is in the folded configuration.

A relatively thin wear-resistant pad 137 is secured to inner surface 9 of cover 20. The pad 137 may be made of a relatively thin polymer material that is stitched to the fabric 132 and backing 133. When the cover 20 is positioned on the internal armrest structure 25, the wear-resistant pad 137 is positioned directly adjacent tab 104 (FIG. 12) at end 66 of actuator member 65. The wear-resistant pad 137 prevents excessive wear to the fabric 132. Also, the wear-resistant pad 137 may have a raised center portion or the like that provides a tactile feel for the user, so the user can determine where to push to release the latch mechanism 15.

An opening 140 in lower portion 141 of cover 20 may be selectively closed by a flap 142. A hook-and-loop fastener including strips 143 and 144 extend around edge 144 of flap 142, and around edge 145 of opening 140 to secure the flap 142 to the rest of the cover 20. A rectangular opening 146 in flap 142 has substantially the same cross-sectional shape and size as connecting structure 29 (FIG. 13). During assembly, flap 142 of cover 20 is opened, and the cover 20 is slid downwardly over the internal armrest with foam cover pieces 112-115 shown in FIGS. 12 and 13. Flap 142 is then closed, with connector 129 extending it through opening 146, and the hook-and-loop connectors are used to close the flap 142. The armrest 6 may then be assembled to the chair support structure 3 utilizing connecting structure 29.

The armrest 6 and cover 20 of the present invention have a very thin cross-section that provides an aesthetically pleasing appearance. Furthermore, the stretchable cover 20 provides a relatively smooth, wrinkle-free outer surface when the armrest 6 is in both the upright position 6B, and the folded position 6A. The latch mechanism can be easily actuated by a user, and the actuating member does not protrude from the handle in a manner that would otherwise detract from the appearance of the armrest. Furthermore, the neoprene or other elastic material covering at least a portion of the armrest 6 provides cushioning, such that the armrest 6 has comfortable surfaces when in both the folded configuration 6A and the upright position 6B. Furthermore, the bias towards the folded position 6A provided by spring 51 and cable 53 keep the upper portion 8 of armrest 6 folded tightly against lower portion 7 to thereby minimize the total width of the chair 1 when one or both of the armrests 6 are in the folded position. Although the armrest has been described as having a single pivot (hinge) and latch mechanism, it will be readily apparent that one or more additional pivots/hinges could be provided, such that the armrest includes upper and lower portions, and an intermediate link (or links) interconnecting the upper and lower portions of the armrest at pivots/hinges. A second latch mechanism or other suitable arrangement could be utilized at the second pivot/hinge.

In use, a user can fold one of the armrests 6 to the folded position, and leave the other armrest 6 in the upright position. The user can then place one or both of his or her legs over the folded armrest, and recline against the other armrest that is in the upright position. In this way, the folded armrest of the present invention permits a mode of use that is difficult and/or uncomfortable in prior chairs.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A chair, comprising:

a base configured to support the chair on a floor surface in a generally upright position;

a user support structure extending upwardly from the base, and including a generally upright back rest portion, and a seat portion having a generally horizontal upper seating surface;

at least one folding armrest, the armrest comprising:

upwardly-extending armrest structure including a lower portion secured to the user support structure, and an upper portion pivotably connected to the lower portion at at least one pivot for rotating movement in first and second rotational directions between a generally upright position wherein the upper portion of the armrest structure extends upwardly from the lower portion of the armrest structure, and a folded position wherein the upper portion extends downwardly from the at least one pivot along side of the lower portion;

a releasable catch mechanism selectively retaining the upper portion in the upright position, the releasable catch mechanism including a first catch having a first catch surface, and a second catch having a second catch surface, wherein at least the first catch surface is movable relative to the second catch surface between an engaged position wherein the first and second catch surfaces are in engagement and the first and second catches substantially prevent pivoting movement of the upper portion of the armrest structure relative to the lower portion of the armrest structure in at least the first rotational direction, and a disengaged position wherein the first and second catches permit pivoting movement of the upper portion of the armrest structure relative to the lower portion of the armrest structure in at least the first rotational direction; and wherein:

the first catch comprises a flexible member having a base portion fixed to the armrest structure, and a resiliently deformable portion that is deformed when the first catch surface is in the disengaged position and biases the first catch surface into the engaged position.

2. The chair of claim 1, wherein:

the first catch comprises an elongated member that deforms by bending to bias the first catch surface into the engaged position.

3. The chair of claim 2, wherein:

the resiliently deformable portion of the first catch has a cross-sectional shape defining a width and a thickness, wherein the width is much greater than the thickness.

4. The chair of claim 3, wherein:

the resiliently deformable portion has a substantially uniform thickness.

5. The chair of claim 4, wherein:

the resiliently deformable portion defines a central plane, and the first catch surface is formed by a lip that extends transversely away from the central plane.

6. The chair of claim 1, wherein:

the first catch includes a base portion that is fixedly secured to one of the upper and lower portions of the armrest support structure, wherein the base portion is adjacent a first end portion of the first catch, and the first catch surface is adjacent a second end portion of the first catch.

7. The chair of claim 6, wherein:

the second catch is connected to the other of the upper and lower portions of the armrest structure, the second catch including a ramp surface adjacent the second catch surface, such that the first catch engages the ramp surface as the upper portion of the armrest structure is rotated from the folded position to the upright position and thereby moves the first catch surface relative to both the second catch surface and the base portion of the first catch.

8. The chair of claim 1, including:

a resilient member biasing the upper portion of the armrest support structure towards the folded position.

9. The chair of claim 8, including:

a cover extending over at least a substantial portion of the armrest wherein the cover is made of an elastic material that stretches when the upper portion of the armrest is in the folded position, and wherein the elastic material contracts to form a substantially wrinkle-free surface when the upper portion of the armrest structure is in the upright position.

10. The chair of claim 9, wherein:

the resilient member comprises a coil spring; and including:

a flexible line connected to the coil spring and extending from one of the upper and lower portions of the armrest structure to the other of the upper and lower portions, and wherein the coil spring tensions the flexible line to create a force tending to rotate the upper portion of the armrest structure to the folded position.

11. The chair of claim 10, wherein:

the upper portion of the armrest structure includes a first groove facing outwardly in a first direction, and the lower portion of the armrest structure includes a second groove facing outwardly in a second direction that is substantially opposite the first direction, and wherein:

the flexible line wraps around and engages the first and second grooves.

12. A chair comprising:

a generally horizontal seat portion and a generally upright back portion, wherein at least a portion of one of the seat portion and the back portion is covered in a layer of a first material defining a first visual appearance and a first stretchability;

a pair of folding armrests, each having internal armrest structure including a lower portion and an upper portion pivotably connected to the lower portion; and a cover covering at least a portion of the upper and lower portions of the internal armrest structure, the cover including a first portion having an outer surface formed by a layer of material having substantially the same first visual appearance as the portion of one of the seat portion and the back portion, the cover further including a second portion having a layer of a second material having a second visual appearance that is substantially different than the first visual appearance, the second material defining a second stretchability that is substantially greater than the first stretchability, and wherein the second material comprises neoprene with stretchable fabric bonded to opposite sides of the neoprene.

* * * * *